United States Patent [19]

Schoeneberg

[11] Patent Number: 4,959,941

[45] Date of Patent: Oct. 2, 1990

[54] PLATFORM CONSTRUCTION

[76] Inventor: Carl M. Schoeneberg, 2025 Schoettler Valley, Chesterfield, Mo. 63017

[21] Appl. No.: 446,437

[22] Filed: Dec. 5, 1989

[51] Int. Cl.[5] ..... E04C 2/42

[52] U.S. Cl. ..... 52/664; 52/669; 52/726; 403/287; 403/341; 182/119

[58] Field of Search ..... 52/6, 7, 726, 669, 664, 52/632; 403/287, 341; 182/119, 130, 223

[56] References Cited

U.S. PATENT DOCUMENTS

| | | | |
|---|---|---|---|
| 3,181,203 | 5/1965 | Wenger | 52/6 |
| 3,633,548 | 1/1972 | Kepple | 52/669 X |
| 3,640,557 | 2/1972 | Nute, Jr. et al. | 403/287 X |
| 3,889,779 | 6/1975 | Kümmerlin | 52/632 X |
| 4,768,620 | 9/1988 | South | 182/223 |

FOREIGN PATENT DOCUMENTS

| | | | |
|---|---|---|---|
| 1536463 | 12/1978 | United Kingdom | 52/664 |

*Primary Examiner*—David A. Scherbel
*Assistant Examiner*—Lan Mai
*Attorney, Agent, or Firm*—Grace J. Fishel

[57] ABSTRACT

An improved means for securing planking to a horizontal support in a platform having a plurality of vertical support frames laterally joined with cross braces for use in constructing bleachers, risers and stages. The vertical support frames have horizontal supports for planking and means are concealed within the underside of the planking to prevent the planking from uplifting or shifting from end to end or back and forth on the horizontal support. The means are in the form of male and female mating endcaps for the planking in cooperation with a hook provided on the horizontal support.

12 Claims, 3 Drawing Sheets

PLATFORM CONSTRUCTION

BACKGROUND OF THE INVENTION

The present invention relates to an improved means for securing planking to a horizontal support in a portable platform construction without the use of loose fastening means such as screws, bolts, clamps, clips or the like.

Various means have been proposed for attaching planking to portable platforms such as bleachers, chair risers and stages. Many of these systems make use of separate hardware which is often lost when the platform is set up or when it is taken down, adding to the cost of staging the event. In addition, portable platforms are frequently used, and often stored, outdoors. The weather causes the fasteners to rust, weakening the structure and making it difficult to assemble and dismantle.

Means for attaching planking making use of planks which are specially fitted with brackets for attachment to each other and to the horizontal supports have been proposed in the past. None are believed to be entirely satisfactory and to have the combination of features found in the present system wherein the means is concealed within the underside of the planking. This minimizes the pinch points on the user's side and makes the platform resistant to unauthorized dismantling or vandalism. In addition, the present system prevents the planking from uplifting when it is walked or sat upon and from shifting from end to end or back and forth on the horizontal support.

It is therefore an object of the present invention to provide a means having the above-mentioned features. Other objects and features of the invention will be in part apparent and in part pointed out hereinafter.

The invention accordingly comprises the constructions hereinafter described and their equivalents, the scope of the invention being indicted in the subjoined claims.

SUMMARY OF THE INVENTION

A platform construction for bleachers, risers and stages has a plurality of vertical support frames laterally joined with cross braces. The vertical support frames have horizontal supports for planking with a hook whose main axis is generally longitudinal to the long axis of the horizontal support. The planking has a cavity at opposite ends and male and female endcaps. A projection longitudinal to the planking is attached to the male endcap. A corresponding aperture is provided in the female endcap for receipt of the projection. An aperture is also provided in the female endcap for receipt of the hook. A portion of the projection is engaged by the hook when the male and female endcaps are mated thereby locking the male and female endcaps to the horizontal support in three dimensions with the hook and projection concealed within the cavity of the planking.

BRIEF DESCRIPTION OF THE DRAWINGS

In the accompanying drawings, in which several of various possible embodiments of the invention are illustrated, corresponding reference characters refer to corresponding parts throughout the several views of the drawings and in which.

DETAILED DESCRIPTION OF THE INVENTION

Figure 1:
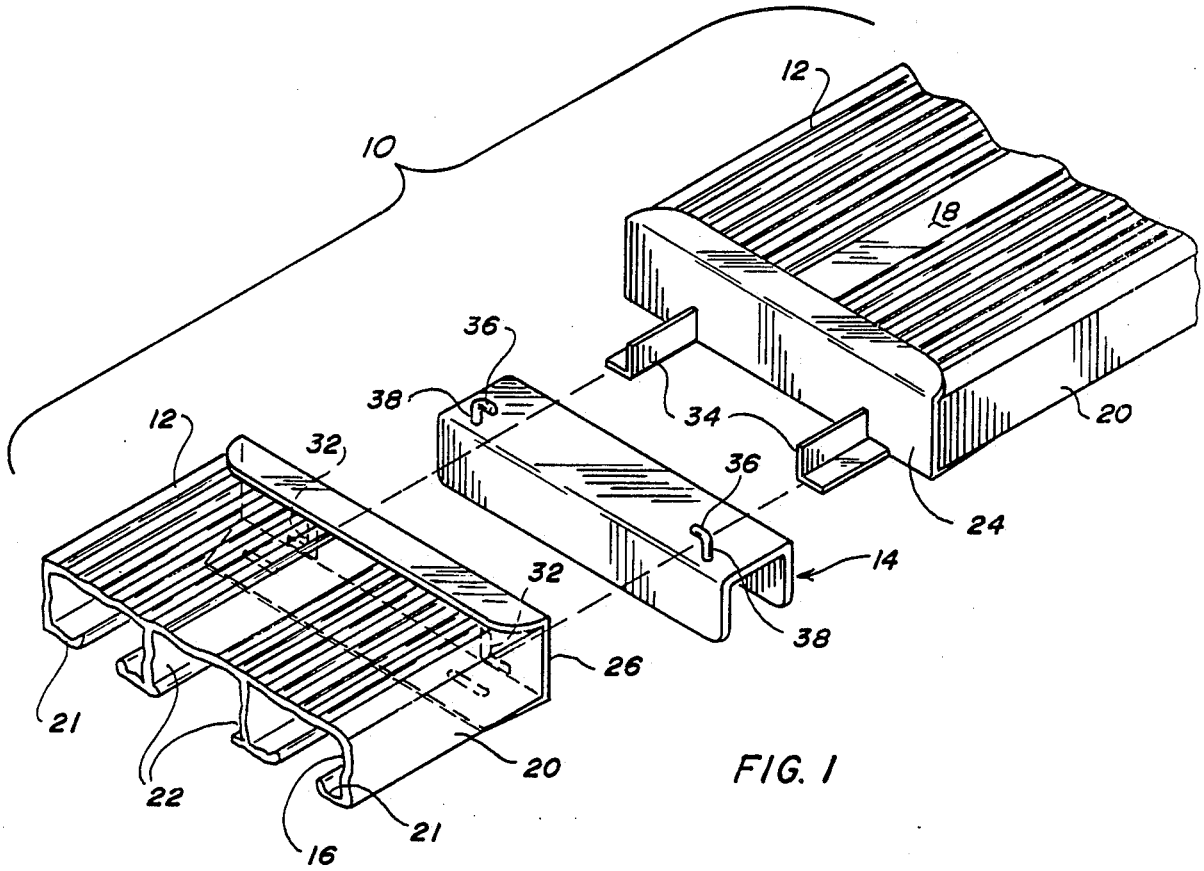
FIG. 1 is an exploded perspective view of an improved means for securing planking to a horizontal support in accordance with the present invention.

Referring to the drawings more particularly by reference character, reference numeral 10 refers to a means for securing planking 12 to a horizontal support 14 for use in constructing a portable platform such as a bleacher, chair riser or stage. Horizontal support 14 is mounted on a vertical support frame, a plurality of which are laterally joined with cross braces. The vertical supports and cross bracing come in a wide variety of designs and shapes depending on whether the portable platform is a bleacher, chair riser or stage. They are not shown in the drawings for purposes of clarity since they form no particular part of the present invention. In the case of risers and stages, the subject invention is used to attach the planks making up the floor whereas in bleachers it can be used to attach seat boards as well as foot boards. Hence it will be understood that with respect to bleachers, the term horizontal support 14 encompasses both seat supports and foot board ledgers in those instances where the seats are structurally separate from the foot boards.

As shown in FIG. 1, planking 12 comprises a shallow channel 16 having a flat top 18 and downwardly turned sides 20 terminated with short inwardly turned flanges 21. When planking 12 is formed of extruded aluminum or the like, one or more longitudinal reinforcing webs 22 are usually attached to the under surface of top 18. These members are not usually present, however, when the planking is formed of fiberglass. For use in the present invention, planking 12 can be made of metal, fiberglass, wood and so forth so long as the planking has hollow ends within which means 10 can be concealed.

For planking 12 in the middle of a span of seating or flooring, the opposite ends of each plank are outfitted with a male endcap 24 and a female endcap 26. In the embodiment of means 10 illustrated in FIGS. 1–3, male endcap 24 comprises a shallow channel 27 with a flat bottom 28 and inwardly turned sides **30*a* and 30*b*. Channel 27 is sized for interference fit over the end of planking 12 with upper side 30*a* overlying top 18 and lower side 30*b* overlying the bottom of planking 12 formed by flanges 21 and webs 22. Channel 27 is attached to planking 12 with rivets or the like pinning opposite lateral edges of side 30*b* to flanges 21. A pair of apertures 32 are provided in bottom 28 adjacent side 30*b*. Insofar as described, female endcap 26 is the same as male endcap 24**.

Male endcap 24 has a pair of projections 34 and female endcap includes a pair of apertures 35, more particularly described hereinafter. Projections 34 are attached to side **30*b* and extend beyond the end of planking 12, passing though apertures 32. It is readily appreciated from the foregoing description that when planks 12 are butted end to end apertures 32 in female endcap 26 are also in registry with projections 34** which pass freely therethrough.

A pair of upstanding hooks 36 are attached to horizontal support 14. Hooks 36 are mounted off centerline of horizontal support 14 so that both ends of abutting planks 12 are equally supported. Hooks 36 are mounted on a shank 38 and are spaced apart a distance such that some portion of projections 34 pass underneath them when adjacent planks are butted end to end. Apertures 35 are sized and positioned such that hooks 36 pass through side **30*b* of female endcap 26 when it is seated on horizontal support 14**.

Figure 2:
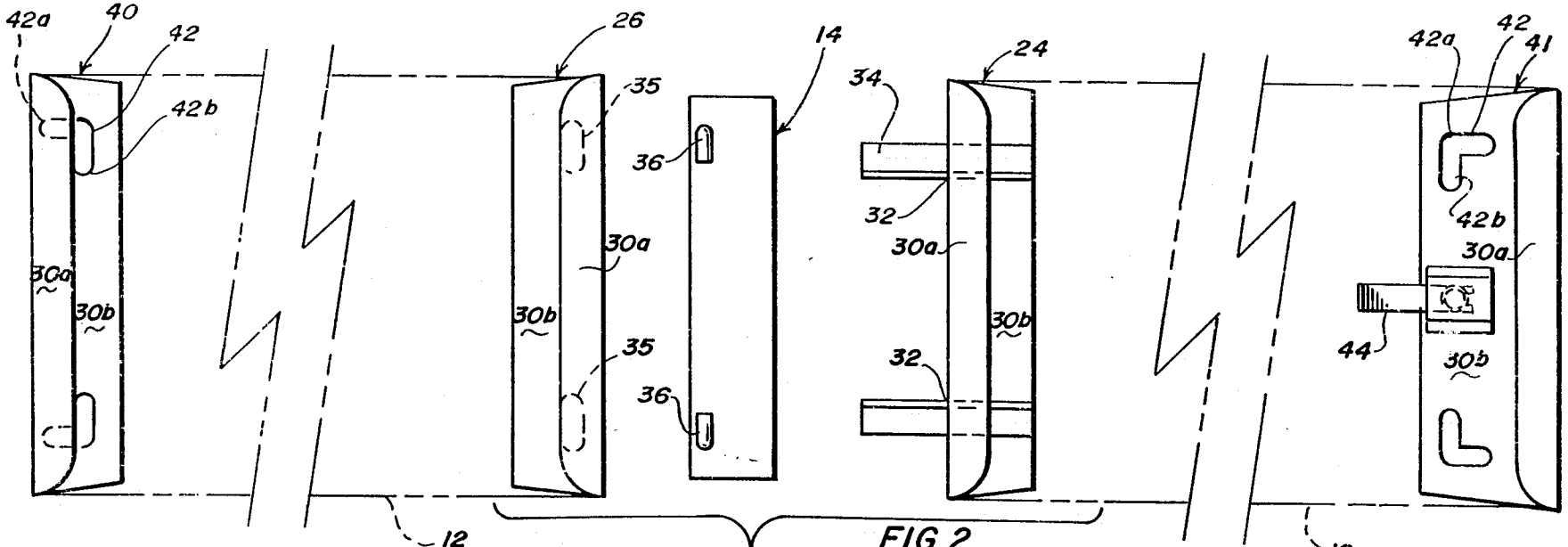
FIG. 2 is a top view of the means for securing planking with the planking shown in dotted lines.
Figure 3:
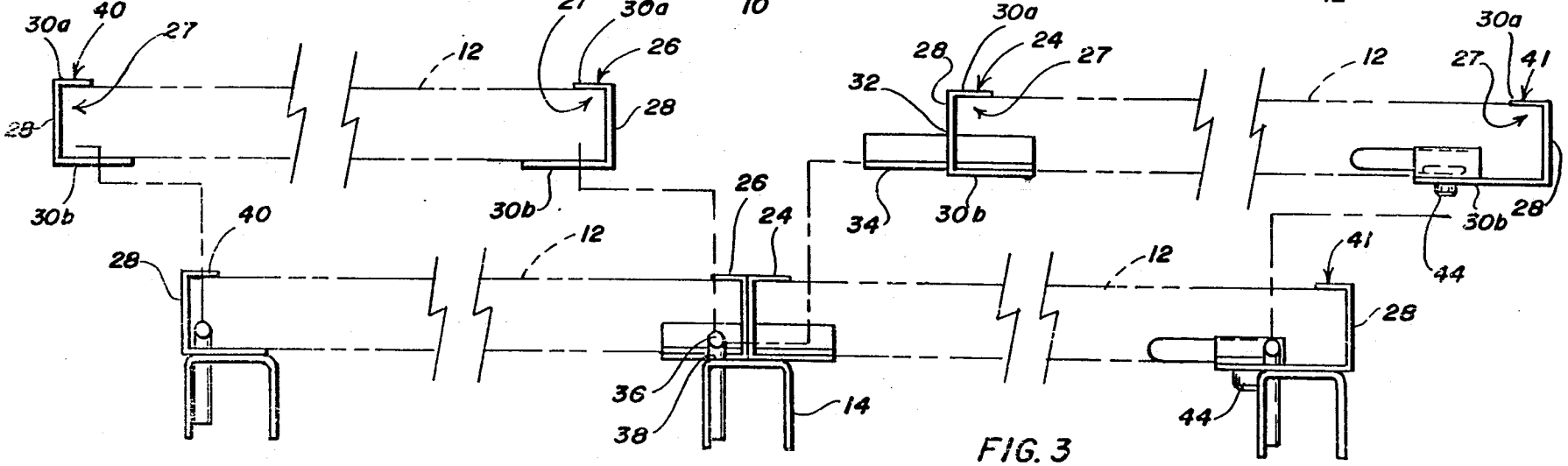
FIG. 3 is a side view of the means for securing planking also shown moved into secured position on the horizontal support.

As illustrated in FIGS. 1–3, hooks 36 are opposing and apertures 32 and projections 34 are L-shaped in cross section and are positioned back to back with their feet **32*b* and 34*b*, respectively, directed laterally towards sides 20. The backs 32*b* of L-shaped apertures 32 serves as a guide for the backs 34*b* of L-shaped projections 34 and in secured position, the feet 34*b* of projections 34 are under hooks 36. The parts of course can be reversed with hooks 36 directed towards sides 20 and with L-shaped apertures 32 and projections 34 in opposition. It will also be appreciated that apertures 32 and projections 34** can be formed as a slot and a flat bar, respectively, or take other angular forms other than L-shaped.

A special starter endcap 40 and a special terminator endcap 41 are substituted for the male endcap on the first plank 12 in a run of seating or flooring and for the female endcap on the last plank 12, respectively. As seen in FIGS. 2 and 3, assembly of planking 12 usually proceeds from left to right as viewed by the user with the planking in front of him. Special endcaps 40 and 41, like endcaps 24 and 26, comprise a shallow channel 27 with a flat bottom 28 and inwardly turned sides **30*a* and 30*b*. Channel 27 is sized for interference fit over the end of planking 12 with upper side 30*a* overlying top 18 and lower side 30*b* overlying the bottom of planking 12 formed by flanges 21 and webs 22. Channel 27 is attached to planking 12 with rivets or the like pinning opposite lateral edges of side 30*b* to flanges 21**.

As illustrated in FIGS. 1–3, a pair of L-shaped apertures 42 having a longitudinal back **42*a* and a transverse foot 42*b* are provided in side 30*b* of endcaps 40 and 41 with backs 42*a* closer to the end of plank 12 than feet 42*b*. Apertures 42 are sized and spaced apart a distance such that hooks 36 pass through feet 42*b* and shanks 38 slide along backs 42*a* with some portion of side 30*b* underneath hooks 36 thus preventing uplift. By selectively positioning the end of backs 42*a* in side 30*b* the outside edge of bottom 28 can be brought flush with the outside edge of horizontal support 14 when shanks 38 are at the endmost extreme of backs 42*a*. Since hooks 36 are mounted off centerline of horizontal support 14, apertures 42 in terminator endcap 41 must be deeper in side 30*b* and side 30*b* wider than its counterpart starter endcap 40. It will be appreciated that apertures 42 in endcaps 40 and 41 can take other geometric forms, the essential feature being that foot 42*b* comprise a first generally transverse slot large enough to pass over hooks 36 and that foot 42*a* comprise a second generally longitudinal contiguous slot large enough for shanks 38 to slide along with some portion of side 30*b* underneath hooks 36**.

A spring clip 44 is provided on side **30*b* of terminator endcap 41. Clip 44 serves as a stop means against horizontal support 14 when shanks 38 are in backs 42*a* thus locking shanks 38 in apertures 42 with hooks 36 overlying some portion of side 30*b* and preventing planking from moving to the right as viewed in FIG. 3, movement to the left being prevented by adjacent plank 12. Clip 44 is preferably resiliently biased in extended or stop position and is retracted when pressed against horizontal support 14** as the last plank is installed.

In use, a selected number of vertical support frames are laterally joined with suitable cross bracing preparing horizontal supports 14 to receive planking 12. Starting at the left end of a run of seats or flooring, the user selects a first plank beginning with a starter endcap and passes the transverse portions **42*b* of apertures 42 over hooks 36. As first plank 12 is pulled to the right, shanks 38 slide in longitudinal portions 42*a* of apertures 42 until they approach the endmost extreme of the slots. Apertures 35 in the opposite end of first plank 12 are then dropped over hooks 36 on a second horizontal support located to the right of the first support. If plank 12 spans more than the distance between two vertical support frames, the horizontal supports between the ends need not be outfitted with hooks 36** but may be as they do not interfere with installation of the plank.

A second plank having endcaps 24 and 26 is butted against the female end of the first plank and projections 34 are inserted through apertures 32 and under hooks 36. Apertures 35 in the opposite end of second plank are dropped over hooks 36 on a third horizontal support located to the right of the first two and so forth until the last plank in the span is reached.

A last plank ending with a terminator endcap 41 is selected by the user and butted against the female end of the next to last plank and projections 34 are inserted though apertures 32 and under hooks 36. As apertures 42 in terminator endcap 41 are dropped over hooks 36, stop means 44 are pressed against horizontal support 14 and are retracted. When the last plank is moved to the left, shanks 38 slide along longitudinal slot **42*a* until they approach the endmost extreme at which point stop means slide off horizontal support 14** and are released thus locking the assembly.

Figure 4:
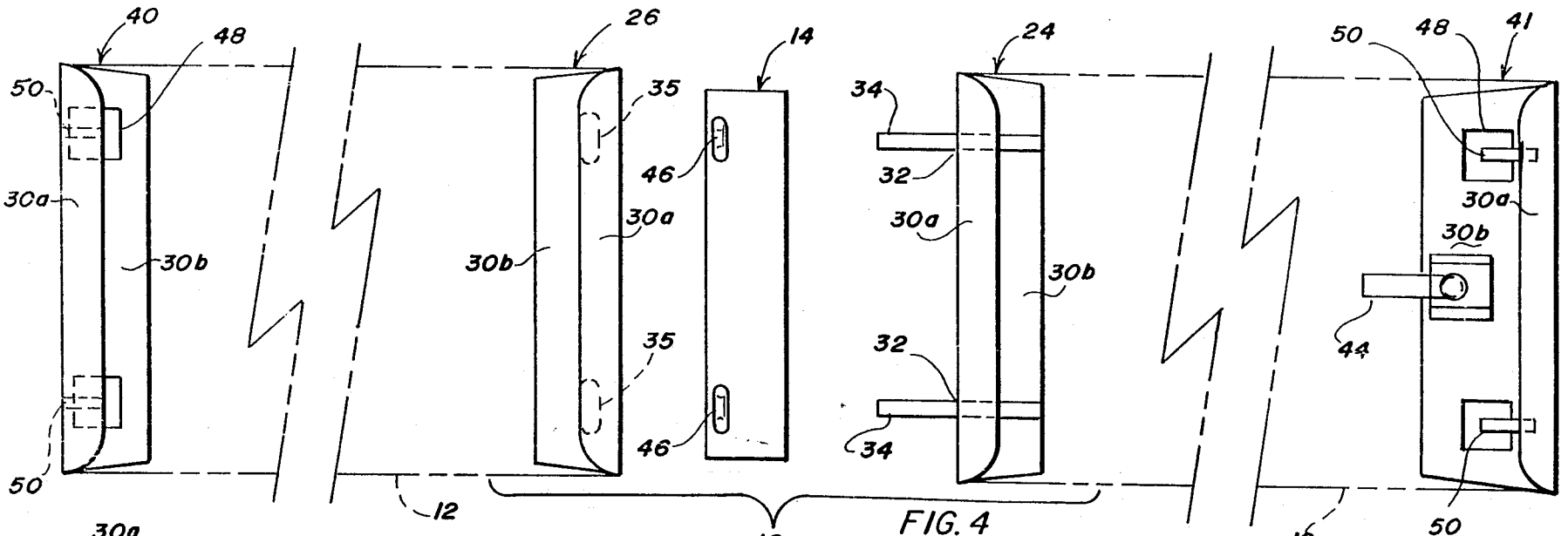
FIG. 4 is a top view of another embodiment of the means for securing planking with the planking shown in dotted lines; and, FIG. 5 is a side view of the second embodiment also shown moved into secured position on the horizontal support.
Figure 5:
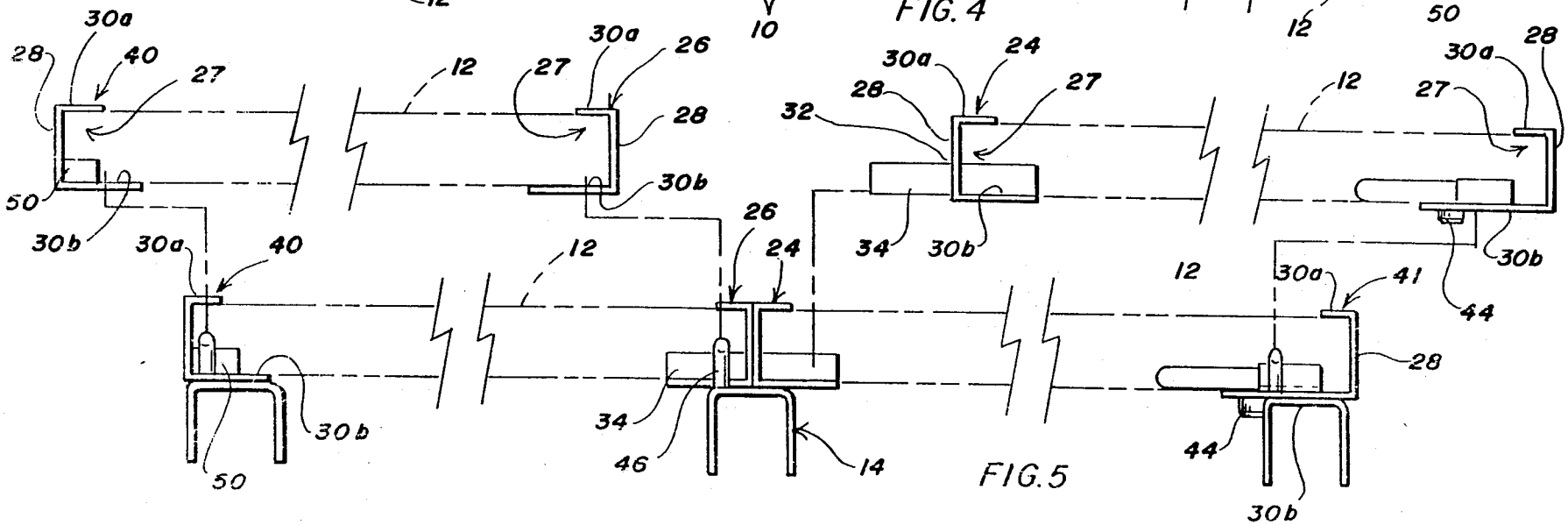

In the embodiment of means 10 illustrated in FIGS. 4 and 5, closed hooks 46 take the place of open hooks 36, projections 34 are flat instead of angled and apertures 32 are slots instead of L-shaped. Endcaps 24 and 26 are otherwise the same and latch with closed hook 46 in the same manner as endcaps 24 and 26 illustrated in FIGS. 1-3.

Starter endcap 40 and terminator endcap 41 have rectangular apertures 48 in place of apertures 42 for use with closed hooks 46. Apertures 48 are partially overhung by longitudinal bars attached to sides **30*b*. As shown in FIG. 5, when apertures 48 in starter endcap 40 are passed over closed hooks 46 and first plank 12 pulled to the right, bars 50 pass between the legs of closed hooks 46 locking endcaps 40 on horizontal support 14. On the opposite end, when apertures 48 in terminator endcap 41 are passed over closed hooks 46 and last plank 12 moved to the left, bars 50 pass between the legs of closed hooks 46 locking endcap 41 to horizontal support 14. Endcaps 40 and 41 in FIGS. 4 and 5 are otherwise the same as endcaps 40 and 41 illustrated in FIGS. 1–3**.

In view of the above it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A platform construction having a plurality of vertical support frames laterally joined with cross braces, the vertical support frames having horizontal supports for planking with an upstanding hook attached to the horizontal support generally longitudinal thereto, planking having a cavity at opposite ends and male and female endcaps, a projection longitudinal to the planking attached to the male endcap, an aperture in the female endcap for receipt of the hook, an aperture in the female endcap for receipt of the projection, a portion of which passes underneath the hook thereby locking male and female endcaps to the horizontal support in three dimensions, said hook and projection concealed within the cavity in the planking.

2. The platform construction of claim 1 wherein the hook is attached to the horizontal support off centerline such that mated male and female endcaps are centered on the horizontal support.

3. A platform construction having a plurality of vertical support frames laterally joined with cross braces, the vertical support frames having horizontal supports for planking with an upstanding hook with a shank attached to the horizontal support generally longitudinal thereto, planking formed from a channel with a top, downwardly turned sides and an open end and having male and female endcaps, said male and female endcaps formed from a channel having a bottom with inwardly turned upper and lower sides, the upper side overlying the top of the channel forming the planking and the lower side overlying the open end thereof, a projection longitudinal to the planking attached to the lower side of the male endcap and passing through an aperture in the bottom thereof, an aperture in the lower side of the female endcap for receipt of the hook, an aperture in the bottom of the female endcap for receipt of the projection, a portion of which passes underneath the hook thereby locking male and female endcaps to the horizontal support in three dimensions.

4. The platform construction of claim 3 wherein the aperture in the bottom of the male and female endcaps and the projection are generally L-shaped in cross section.

5. The platform construction of claim 3 wherein the aperture in the bottom of the male and female endcaps is a slot and the projection is a bar.

6. The platform construction of claim 3 wherein the hook is closed.

7. The platform construction of claim 3 wherein a starter endcap is substituted for the male endcap in the first planking member in a run, said starter endcap formed from a channel having a bottom with inwardly turned upper and lower sides, the upper side overlying the top of the channel forming the planking and the lower side overlying the open end thereof, an aperture in the lower side having a generally transverse slot for receipt of the hook and a contiguous generally longitudinal slot for receipt of the shank with some portion of the lower side of the channel forming the endcap underneath the hook, said longitudinal slot being closer to the bottom than the transverse slot, whereby the starter endcap is locked to the horizontal support in three dimensions when the shank is in the longitudinal slot.

8. The platform construction of claim 3 wherein a terminator endcap is substituted for the female endcap in the last planking member in a run, said terminator endcap formed from a channel having a bottom with inwardly turned upper and lower sides, the upper side overlying the top of the channel forming the planking and the lower side overlying the open end thereof, an aperture in the lower side having a generally transverse slot for receipt of the hook and a contiguous generally longitudinal slot for receipt of the shank with some portion of the lower side of the channel forming the endcap underneath the hook, said longitudinal slot being closer to the bottom than said transverse slot, whereby the terminator endcap is locked to the horizontal support in three dimensions when the shank is in the longitudinal slot.

9. The platform construction of claim 8 wherein a stop is provided on the lower side of the channel forming the endcap limiting longitudinal movement of the last planking member and keeping the shank in the longitudinal slot.

10. The platform construction of claim 3 wherein the hook is closed and wherein a starter endcap is substituted for the male endcap in the first planking member in a run, said starter end cap formed from a channel having a bottom with inwardly turned upper and lower sides, the upper side overlying the top of the channel forming the planking and the lower side overlying the open end thereof, an aperture in the lower side for receipt of the hook permitting limited longitudinal movement therein, a longitudinal bar partially overhanging the aperture extending away from the bottom and passing through the closed hook when the hook is in a portion of the aperture closer to the bottom whereby the starter endcap is locked to the horizontal support in three dimensions.

11. The platform construction of claim 3 wherein the hook is closed and wherein a terminator endcap is substituted for the female endcap in the last planking member in a run, said terminator endcap formed from a channel having a bottom with inwardly turned upper and lower sides, the upper side overlying the top of the channel forming the planking and the lower side overlying the open end thereof, an aperture in the lower side for receipt of the closed hook permitting limited longitudinal movement therein, a longitudinal bar partially overhanging the aperture extending away from the bottom and passing through the closed hook when the hook is in a portion of the aperture closest to the bottom whereby the terminator endcap is locked to the horizontal support in three dimensions.

12. The platform construction of claim 11 wherein a stop means is provided on the lower side of the channel forming the endcap limiting longitudinal movement of the last planking member and keeping the closed hook in that portion of the aperture where longitudinal bar passes therethrough.

* * * * *